US010074931B2

(12) United States Patent
Ma et al.

(10) Patent No.: US 10,074,931 B2
(45) Date of Patent: Sep. 11, 2018

(54) WATERPROOF CONNECTOR AND ASSEMBLY METHOD

(71) Applicant: MiiCs & Partners (Shenzhen) Co., Ltd., Shenzhen (CN)

(72) Inventors: Ying-Chi Ma, New Taipei (TW); Li-He Dai, Foshan (CN)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/485,403

(22) Filed: Apr. 12, 2017

(65) Prior Publication Data

US 2018/0123279 A1 May 3, 2018

(30) Foreign Application Priority Data

Oct. 31, 2016 (CN) ..... 2016 1 0942171

(51) Int. Cl.
*H01R 13/52* (2006.01)
*H01R 43/00* (2006.01)

(52) U.S. Cl.
CPC ..... *H01R 13/5213* (2013.01); *H01R 13/5202* (2013.01); *H01R 43/005* (2013.01)

(58) Field of Classification Search
CPC ..... H01R 13/447; H01R 13/5219; H01R 13/5208
USPC ..... 439/135, 142, 271, 272, 587
See application file for complete search history.

(56) References Cited

U.S. PATENT DOCUMENTS 4,072,154 A * 2/1978 Anderson ..... A61N 1/3752 174/152 GM
5,571,023 A * 11/1996 Anthony ..... H02G 3/14 220/242
5,588,853 A * 12/1996 Anthony ..... H01R 13/5213 220/375
8,047,862 B2 * 11/2011 Lilie ..... H01R 13/5219 439/271
8,628,252 B2 * 1/2014 Matsumoto ..... G02B 6/3879 385/56
8,961,191 B2 * 2/2015 Hanshew ..... H01R 39/64 439/21

* cited by examiner

*Primary Examiner* — Thanh Tam Le
(74) *Attorney, Agent, or Firm* — ScienBiziP, P.C.

(57) ABSTRACT

The waterproof connector includes a cover and a waterproof connector component cooperated with the cover. The waterproof connector component comprises a body, a gasket and a fastening piece, an outer surface of the body has a first groove and a second groove, the gasket is positioned on the first groove, the fastening piece is positioned on the second groove.

9 Claims, 7 Drawing Sheets

WATERPROOF CONNECTOR AND ASSEMBLY METHOD

CROSS-REFERENCE TO RELATED APPLICATIONS

This application claims priority to Chinese Patent Application No. 201610942171.5 filed on Oct. 31, 2016, the contents of which are incorporated by reference herein.

FIELD

The subject matter herein generally relates to a connector, especially relates to a waterproof connector.

BACKGROUND

While connecting network line in outdoor, the line is connected with tape or connectors. While using tape, the temperature and water may make the tape broken and the line may poor contact and the line be leakage. The connectors usually include a body and a nut cooperated with the body. While using the connectors, the nut always loosed, thus, water and dust may enter the body of the connectors to impact waterproofness of the connectors.

BRIEF DESCRIPTION OF THE DRAWINGS

Implementations of the present technology will now be described, by way of example only, with reference to the attached figures.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

Figure 1:
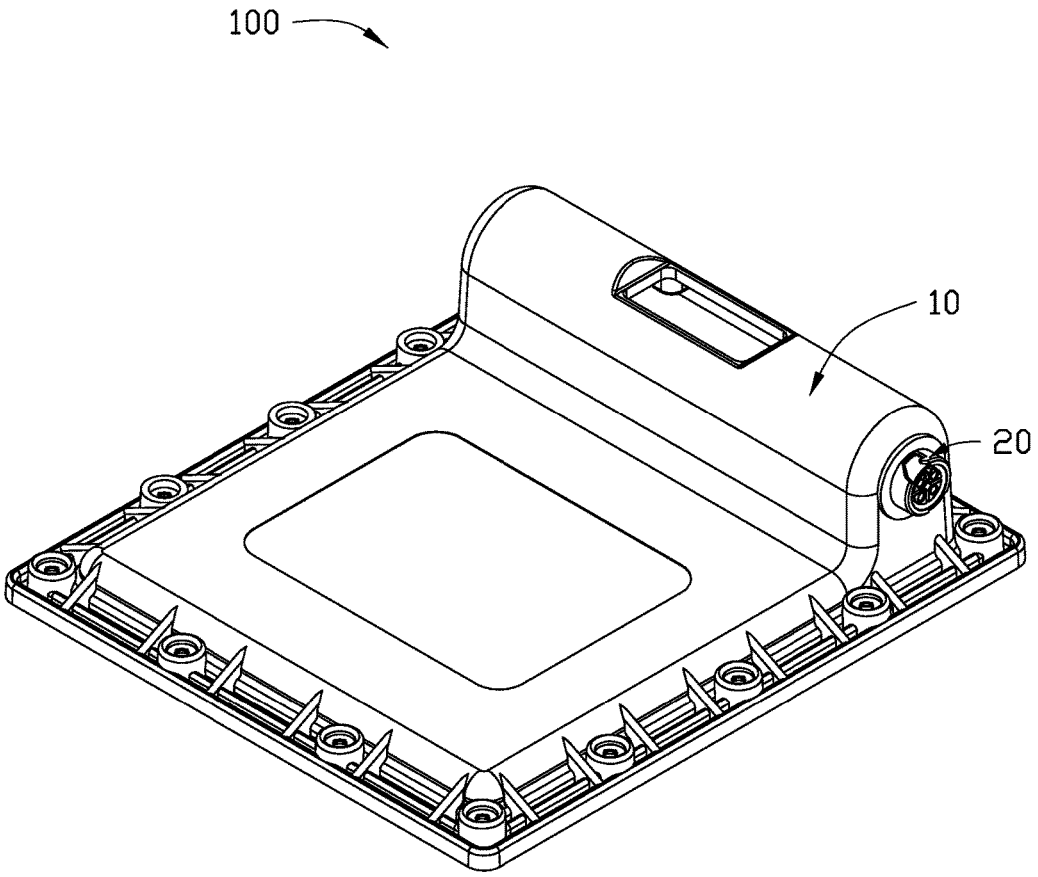
FIG. 1 is an isometric view of a waterproof connector of the present disclosure.
Figure 2:
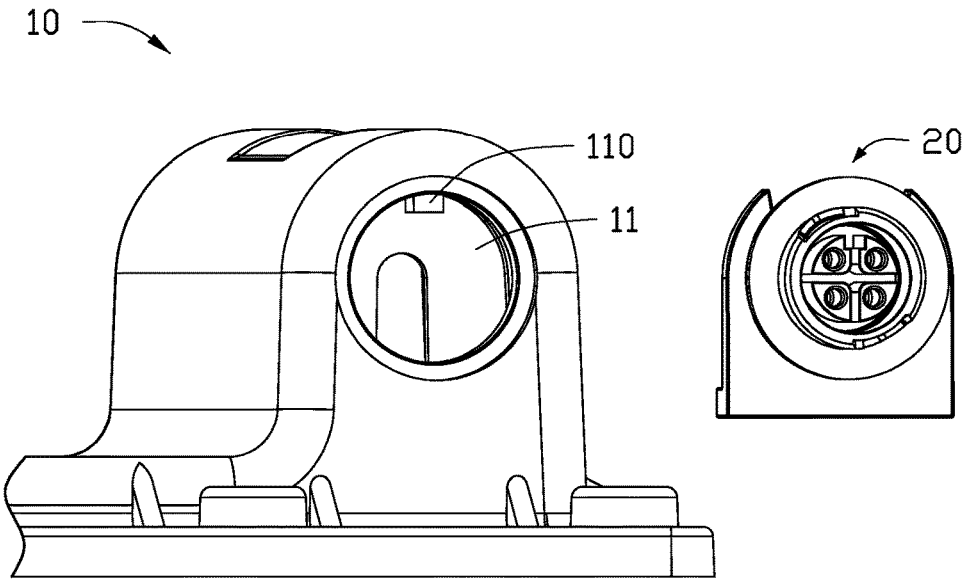
FIG. 2 is a partial exploded view of the waterproof connector of FIG. 1.

Referring to FIGS. 1-2, a waterproof connector 100 includes a cover 10 and a waterproof connector component 20 cooperated with the cover 10.

The cover 10 has a mounting hole 11 used for connecting to the waterproof connector component 20. The mounting hole 11 protruded inwardly to form a fixed block 110.

Figure 3:
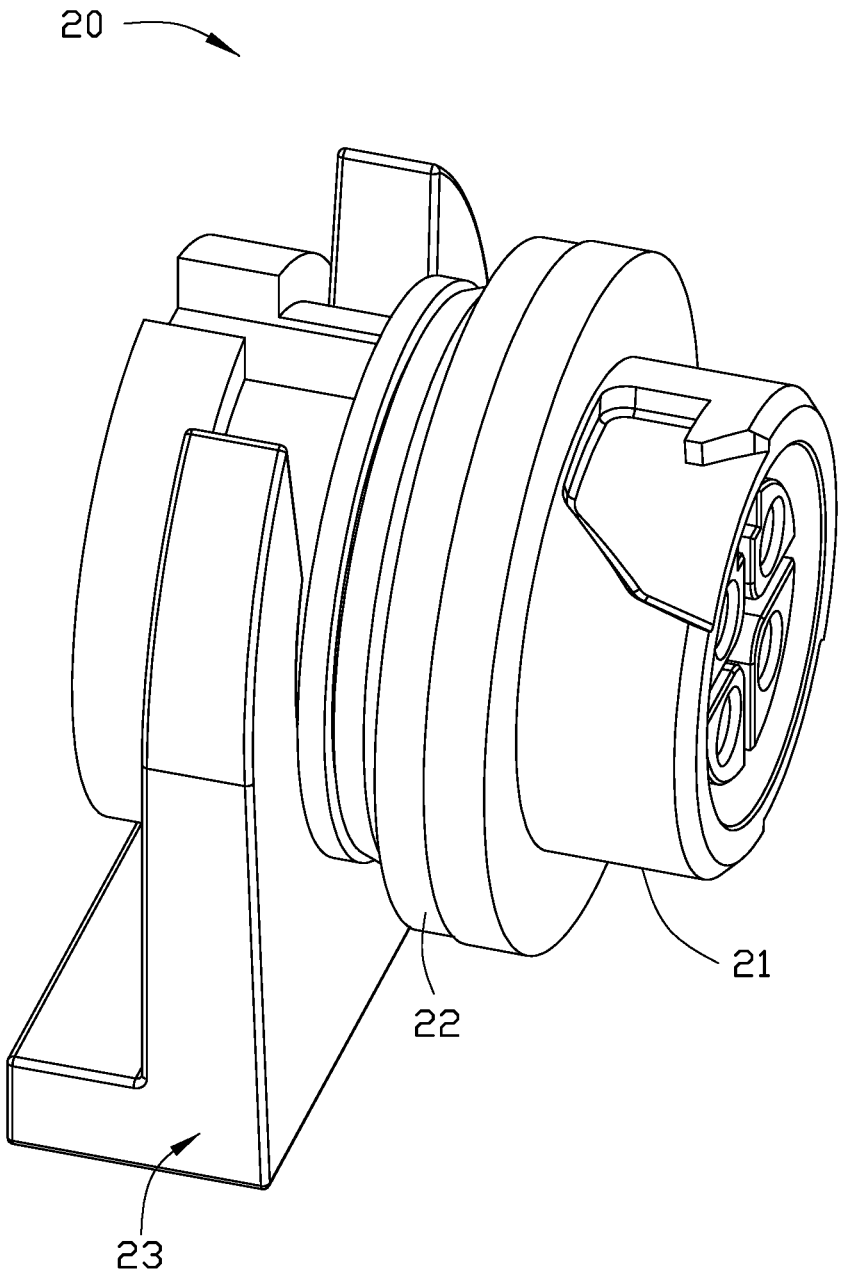
FIG. 3 is an isometric view of a waterproof connected component of the waterproof connector of FIG. 1.
Figure 4:
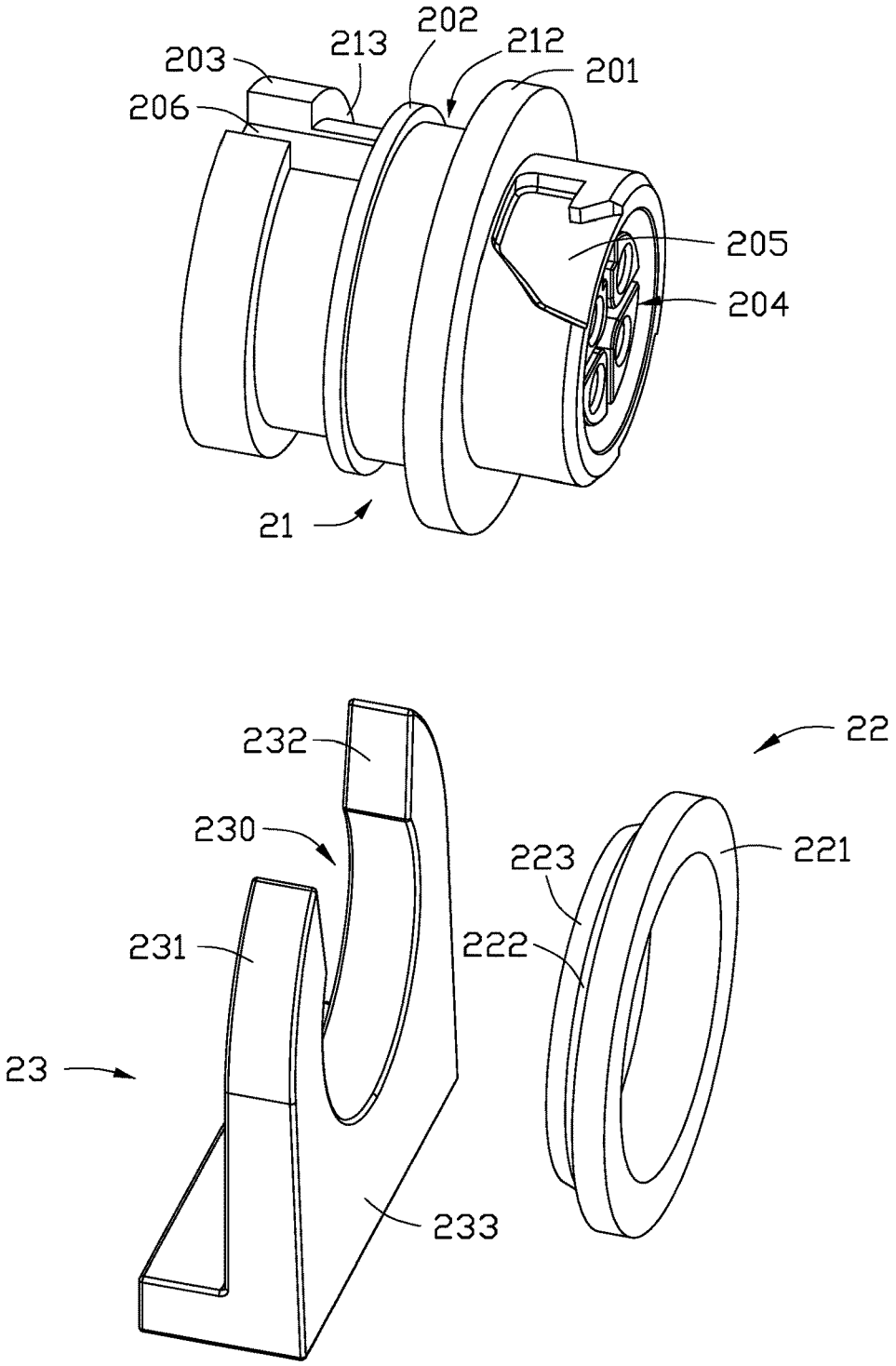
FIG. 4 is an exploded view of the waterproof connected component of FIG. 3.

Also referring to FIGS. 3-4, the waterproof connector component 20 includes a body 21, a gasket 22 around an outer surface of the body 21, and a fastening piece 23 mounted on the outer surface of the body 21.

The body 21 is consisted of multiple cylinders which have different diameters and a common axis. The outer surface of the body 21 protruded outwardly to form a first ring 201, a second ring 202 and a third ring 203 spaced form the second ring 202. The second ring 202 locates between the first ring 201 and the third ring 203. A diameter of the first ring 201, the second ring 202 and the third ring 203 are greater than that of the body 21. The diameter of the first ring 201 is greater than that of the second ring 202. The diameter of the second ring 202 is equal to that of the third ring 203.

The first ring 201 and the second ring 202 commonly define a first groove 212 for placing the gasket 22 therein. The second ring 202 and the third ring 203 commonly define a second groove 213 for placing the fastening piece 23 therein. A diameter of a cylinder correspondingly to the first groove 212 is greater than a diameter of a cylinder correspondingly to the second groove 213.

An end of the body 21 closed to the first ring 201 forms a connecting portion 204. An outer surface of the connecting portion 204 forms a locating slot 205. Thus, the body 21 is coupled with a cable terminal through the connecting portion 204. Another end of the body 21 closed to the third ring 203 forms a positioning groove 206 cooperated with the fixed block 110 therein. The positioning groove 206 extends through the third ring 203 and the second groove 213.

The gasket 22 has ring shaped and has uniform inner diameter. The gasket 22 includes a first portion 221, a second portion 222 closed to the first portion 221, and the third portion 223 closed to the second portion 222. An outer diameter of the first portion 221 is greater than that of the second portion 222. An outer diameter of the third portion 223 gradually decreases away from the second portion 222. While the gasket 22 is positioned on the first groove 212, the first portion 221 of the gasket 22 contacted with the first ring 201. The outer diameter of the first portion 221 is either equal to or less than the outer diameter of the first ring 201. A least outer diameter of the third portion 223 is either equal to or less than the outer diameter of the second ring 202.

The fastening piece 23 includes a first extending portion 231, a second extending portion 232 opposite to the first extending portion 231, and a connection portion 233 connecting the first extending portion 231 and the second extending portion 232. The first extending portion 231, the second extending portion 232 and the connection portion 233 commonly define an open 230. An inner surface of the first extending portion 231 is parallel with an inner surface of the second extending portion 232. An inner surface of the connection portion 233 is a circular arc face.

While the waterproof connector 100 is assembled, the body 21 inserts the mounting hole 11 of the cover 10, the fixed block 110 is positioned on the positioning groove 206 to prevent the waterproof connector component 20 rotating relative to the cover 10. The first ring 201 contacts with an outer surface of the cover 10. The gasket 22 is positioned on the first groove 212 to prevent form water into the cover 10. The fastening piece 23 is mounted on the second groove 213. Thus, the first ring 201 and the fastening piece 23 commonly limits the waterproof connector component 20 to move relative to the cover 10 along an axis of the cover 10. Further, the fastening piece 23 can increase reinforce tightness between the waterproof connector component 20 and the cover 10.

Figure 5:
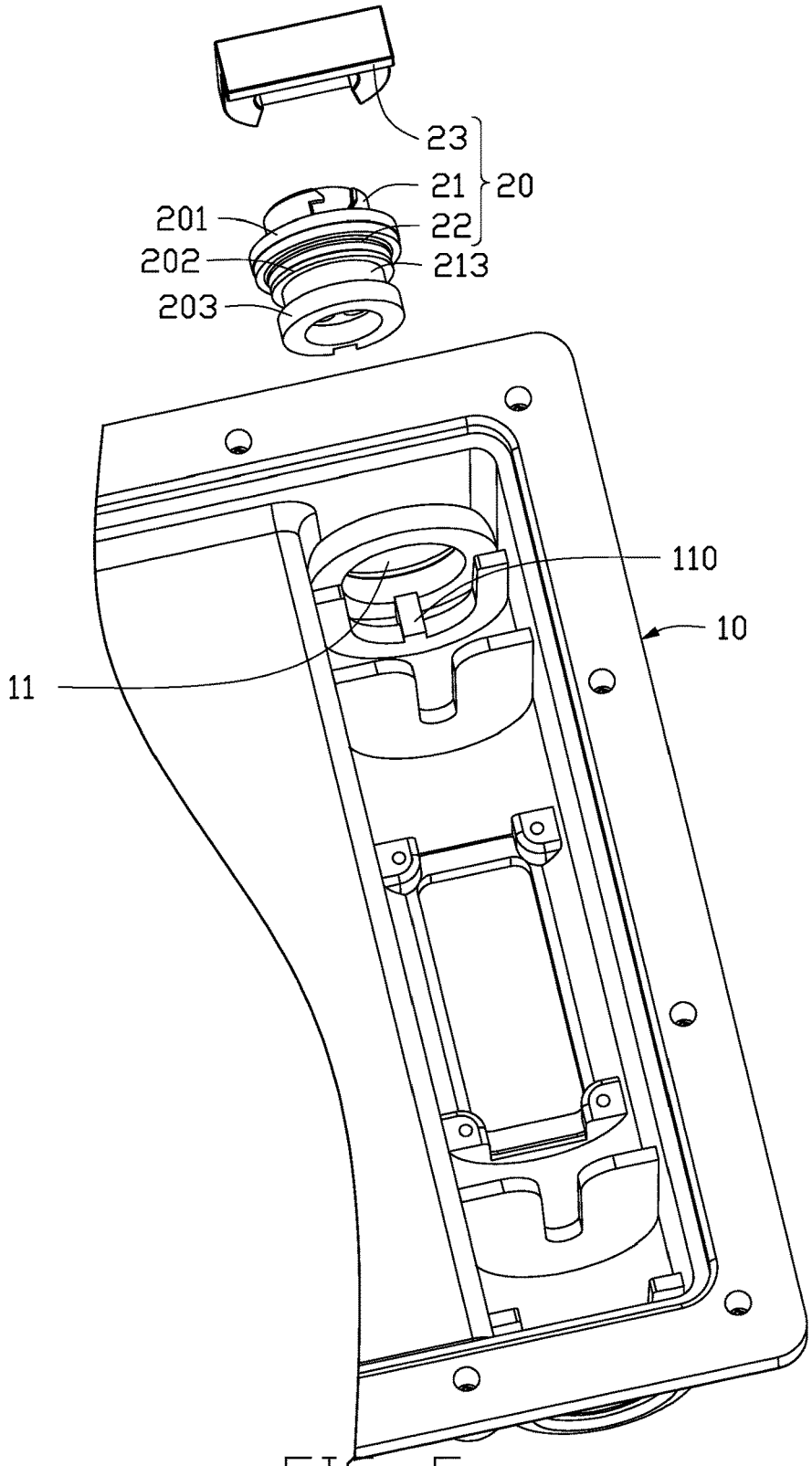
FIGS. 5-7 are assembly method of the waterproof connector of FIG. 1.
Figure 6:
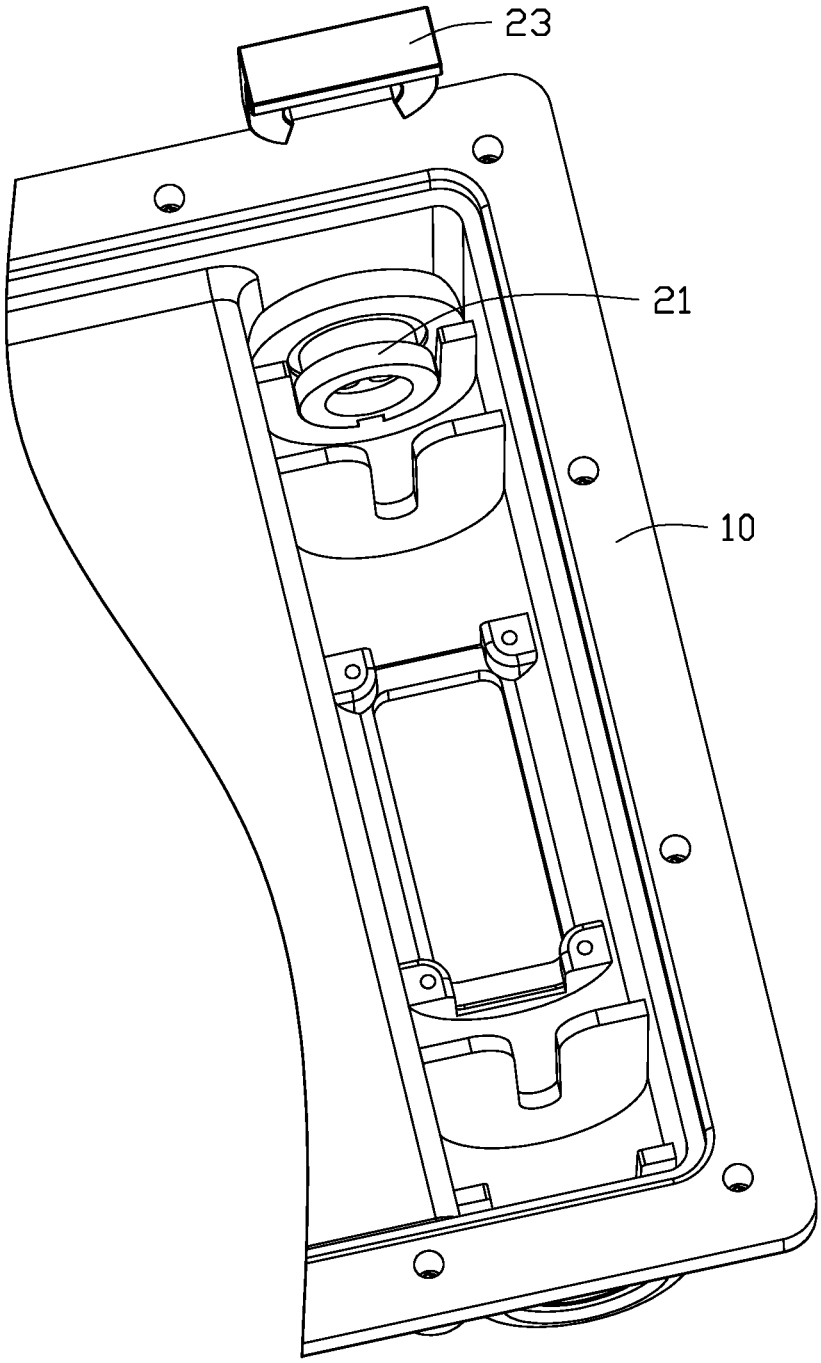
Figure 7:
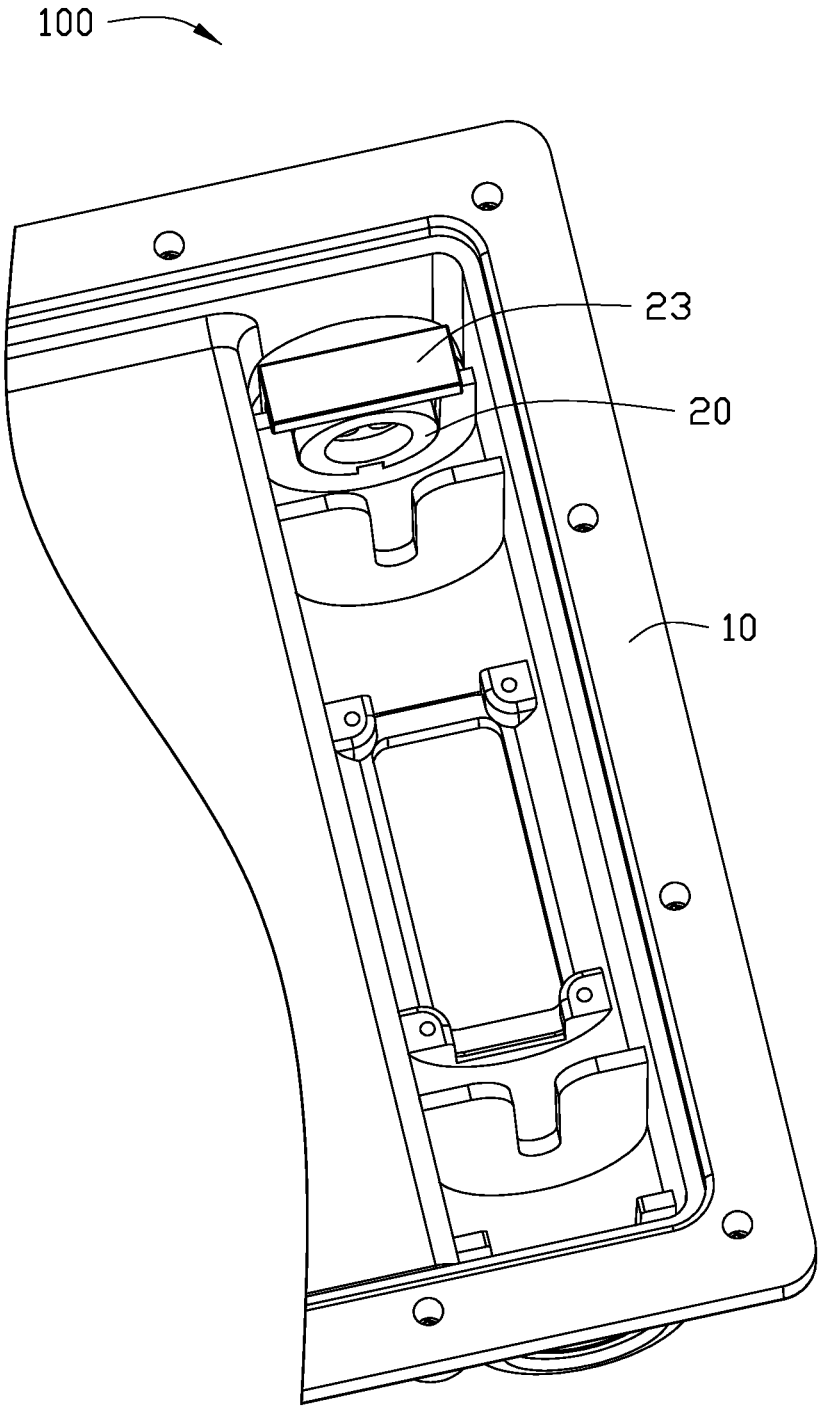

Referring to FIGS. 5-7, an assembly method of the waterproof connector 100 includes the follow steps:

Referring to FIG. 5, providing a cover 10 and a body 21, a gasket 22, and a fastening piece 23, positing the gasket 22 on the body 21.

The cover 10 has a mounting hole 11. The mounting hole 11 protruded inwardly form a fixed block 110. An outer surface of the body 21 protruded outwardly to form a first ring 201, a second ring 202 and the third ring 203. The second ring 203 locates between the first ring 201 and the third ring 203. A diameter of the first ring 201, the second ring 202 and the third ring 203 is greater than that of the body 21. The diameter of the first ring 201 is greater than that of the second ring 202 and the third ring 203. The diameter of the second ring 202 is equal to that of the third ring 203. The first ring 201 and the second ring 202 commonly define a first groove 212 for placing the gasket 22 therein. The second ring 202 and the third ring 203 commonly define a second groove 213 for placing the fastening piece 23 therein. Further, an end of the body 21 closed to the third ring 203 forms a positioning groove 206 for cooperated with the fixed block 110 therein. The positioning groove 206 extends through the third ring 203 and the second groove 213.

Referring to FIG. 6, inserting the body 21 into the mounting hole 11 of the cover 10.

While inserting, the fixed block 110 is need to aim at the positioning groove 206. The first ring 201 contacts with an outer surface of the cover 10.

Referring to FIG. 7, inserting the fastening piece 23 into the second groove 213 to reinforce tightness between the waterproof connector component 20 and the cover 10.

Thus, the first ring 201 and the fastening piece 23 commonly prevent the waterproof connector component 20 rotating around an axis of the cover 10.

The embodiments shown and described above are only examples. Many details are often found in the art such as the other features of a waterproof connector 100 and assembly method. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A waterproof connector comprising:

a cover defining a mounting hole;

a waterproof connector component cooperating with the cover through the mounting hole;

wherein the waterproof connector component comprises a body, a gasket and a fastening piece, an outer surface of the body defining a first groove and a second groove, the gasket is positioned in the first groove, the fastening piece is positioned in the second groove; and wherein the fastening piece comprising a first extending portion, a second extending portion opposite to the first extending portion, and a connection portion connecting the first extending portion and the second extending portion, the first extending portion, the second extending portion and the connection portion commonly define an open, an inner surface of the first extending portion is parallel with an inner surface of the second extending portion, an inner surface of the connection portion is a circular arc face.

2. The waterproof connector of claim 1, wherein the body comprises multiple cylinders, the cylinders have a common axis and different diameters, a diameter of a cylinder correspondingly to the first groove is greater than a diameter of a cylinder corresponding to the second groove.

3. The waterproof connector of claim 1, wherein an outer surface of the body protrudes outwardly to form a first ring, a second ring and a third ring spaced from the second ring, the second ring locates between the first ring and the third ring.

4. The waterproof connector of claim 3, wherein the first ring and the second ring commonly define the first groove, the second ring and the third ring commonly define a second groove.

5. The waterproof connector of claim 3, wherein a diameter of the first ring, the second ring and the third ring are greater than the diameter of the body, the diameter of the first ring is greater than the diameter of the second ring, the diameter of the second ring is equal to that of the third ring.

6. The waterproof connector of claim 3, wherein the mounting hole protrudes inwardly to form a fixed block, an end of the body close to the third ring forms a positioning groove cooperating with the fixed block, the positioning groove extends through the third ring and the second groove.

7. The waterproof connector of claim 6, wherein an end of the body closed to the first ring forms a connecting portion, an outer surface of the connecting portion forms a locating slot.

8. The waterproof connector of claim 1, wherein the gasket includes a first portion, a second portion closed to the first portion, and the third portion closed to the second portion, an outer diameter of the first portion is greater than the outer diameter of the second portion, an outer diameter of the third portion gradually decreases away from the second portion.

9. An assembly method for a waterproof connector, comprising:

providing a cover, a body, a gasket positioned on a first groove of the body, and a fastening piece;

positioning the gasket on the body; an outer surface of the body protruded outwardly to form a first ring, a second ring and a third ring spaced from the second ring, the second ring locates between the first ring and the third ring, the first ring and the second ring commonly define the first groove, the second ring and the third ring commonly define a second groove;

inserting the body into a mounting hole in the cover; the mounting hole protruded inwardly to form a fixed block, an end of the body closed to the third ring forms a positioning groove cooperated with the fixed block, the positioning groove extends through the third ring and the second groove;

inserting the fastening piece into a second groove of the body.

* * * * *